US006109144A

United States Patent [19]

Muro

[11] Patent Number: 6,109,144

[45] **Date of Patent: *Aug. 29, 2000**

[54] SUCCESSIVE SCREW FEEDER DRIVER

[75] Inventor: Narahiko Muro, Tokyo, Japan

[73] Assignee: Muro Corporation, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/860,733

[22] PCT Filed: Jul. 5, 1996

[86] PCT No.: PCT/JP96/01874

§ 371 Date: Jul. 9, 1997

§ 102(e) Date: Jul. 9, 1997

[87] PCT Pub. No.: WO97/18062

PCT Pub. Date: May 22, 1997

[51] Int. Cl.[7] ..... B25B 23/06

[52] U.S. Cl. ..... 81/434; 81/435

[58] Field of Search ..... 81/57.37, 431, 81/433–435, 180.1, 185.2

[56] References Cited

U.S. PATENT DOCUMENTS

| | | | |
|---|---|---|---|
| 4,054,067 | 10/1977 | Blank | 81/58.1 |
| 4,062,389 | 12/1977 | Lejdegard | 81/434 |
| 5,101,697 | 4/1992 | Fishbach | 81/434 |
| 5,662,011 | 9/1997 | Habermehl | 81/434 |
| 5,826,468 | 10/1998 | Daubinger et al. | 81/434 |

FOREIGN PATENT DOCUMENTS

| | | |
|---|---|---|
| 56-2365 | 1/1981 | Japan . |
| 1-240276 | 9/1989 | Japan . |
| 6-106483 | 4/1994 | Japan . |

*Primary Examiner*—D. S. Meislin

*Attorney, Agent, or Firm*—Ronald E. Greigg; Edwin E. Greigg

[57] ABSTRACT

A successive screw feeder driver capable of using plural types of screws of different lengths, capable of finely adjusting a screw driving position, and further capable of coping with a difference in the mounting position of a belt-like number of plurality of screws. A screw driving bit is connected detachably to a screw driving mechanism and a screw feed mechanism is slidable longitudinally connected to a front portion of the screw driving mechanism. An adjusting mechanism for adjusting a longitudinal position of the bit is constituted in the screw driving mechanism. A screw feed device is constituted in the screw feed mechanism for feeding screws arranged side-by-side on the belt-like member up to a screw driving position where each screw is driven separately by the bit, in an interlock with the screw driving operation performed for the bit. In the screw feed mechanism are formed a plurality of guide passages for the plurality of screws on the belt-like member so as to permit replacement and loading of plural types of screws. Further, a front-end block having an abutment surface at a front end thereof is constituted in the screw feed mechanism so as to be slidable longitudinally with respect to the screw feed mechanism.

10 Claims, 11 Drawing Sheets

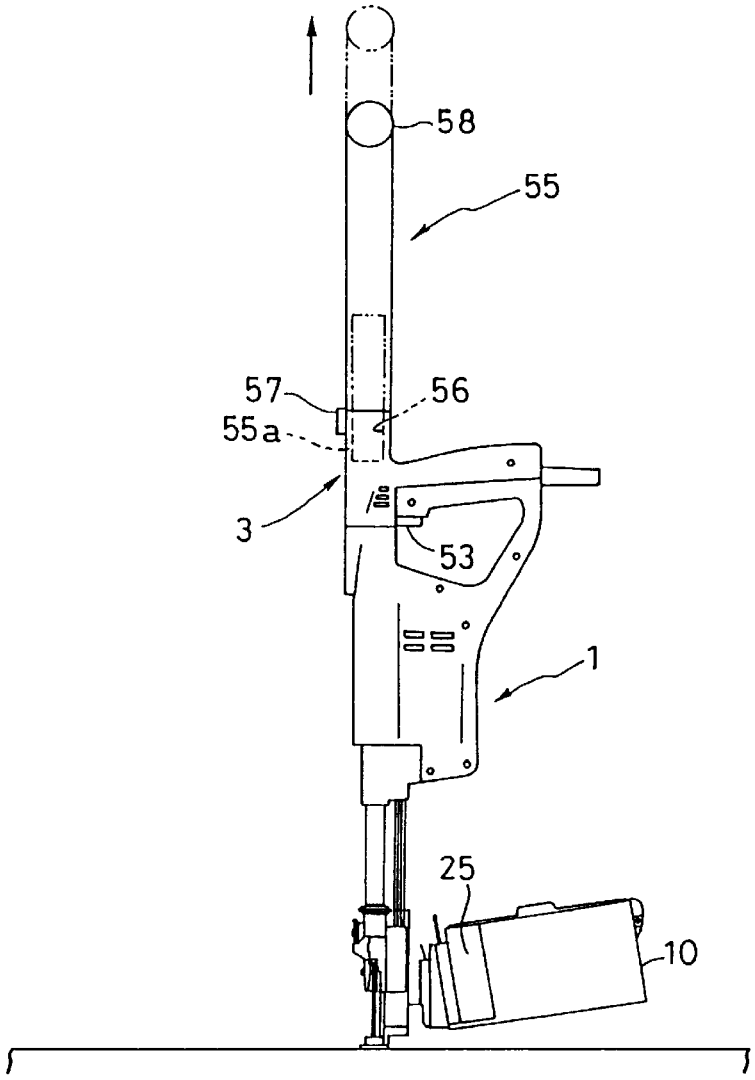
FIG. 16
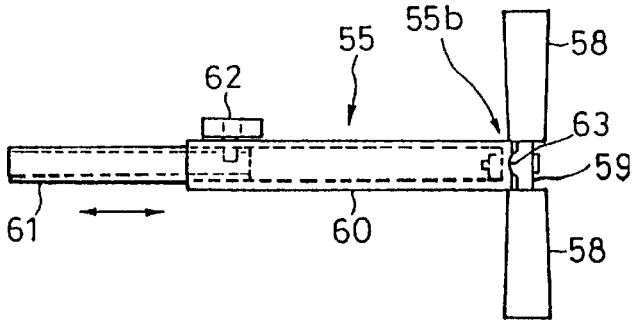
FIG. 17
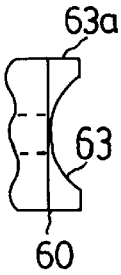
FIG. 17(a)
FIG. 17(b)
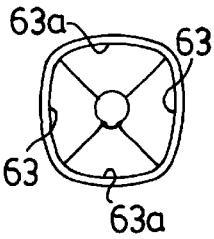

SUCCESSIVE SCREW FEEDER DRIVER

TECHNICAL FIELD

The present invention relates to a successive screw feeder driver for feeding and driving screws successively into a plate such as, for example, a wooden plate, a metallic plate, or a plaster board to fix the plate to a floor surface or a wall surface. Particularly, the invention is concerned with a successive screw feeder driver capable of driving plural types of screws different in length and capable of finely adjusting the state of such screw driving operation.

BACKGROUND OF THE INVENTION

Heretofore there have been proposed successive screw feeder drivers capable of successively feeding and driving screws into a plate such as a wooden plate, a metallic plate, or a plaster board to fix the plate to a floor surface or a wall surface. For example, a conventional successive screw feeder driver of this type is shown in FIG. 18. In this conventional successive screw feeder driver, which is indicated at 101, a drive unit 104 is mounted within a screw driving mechanism body 103 having a grip handle 102, and a screw feed mechanism body 106 is attached to the screw driving mechanism body 103 through a support member 105 so as to be slidable in the screw feeding and driving direction which is the longitudinal direction. In the successive screw feeder driver 101, each screw S is rotated with a rod-like screw driving bit 107 corresponding to a screwdriver as a commonly-used tool. As soon as the screw S is driven into the surface of a plate, the screw feed mechanism body 106 moves back slowly toward the screw driving mechanism body 103 (in the direction of arrow X), and when the nose end of the bit 107 and the front end of the screw feed mechanism body 106 assume substantially the same position, the screw S driving operation is over.

In the successive screw feeder driver 101, as shown in FIG. 19, a large number of screws S, S, . . . are arranged in a line on a belt-like member of a screw strip S1, the belt-like member being formed of a synthetic resin. The screw strip S1 is received in a spiral form into a magazine 108 which is generally cylindrical. In an interlock with a screw feeding operation performed in the screw feed mechanism body 106 the screw strip S1 is advanced to a screw driving position. When the successive screw feeder driver 101 is to be used, the drive unit 104 mounted within the screw driving mechanism body 103 is started to rotate by depressing a trigger switch 109 corresponding to the forefinger position of a grip handle 102, causing the bit 107 to rotate through a reduction mechanism 110 and a clutch 111. The nose end of the bit 107 thus rotated comes into abutment against the head portion of a screw S positioned at the front end of the screw strip which has been loaded into the screw feed mechanism body 106.

The screw S is driven into the surface of a workpiece such as a plate by the rotating motion of the bit 107. The magazine 108 which receives therein the screw strip S1 in a coil form is attached removably to a side face of the screw driving mechanism body 103. The screw strip S1 accommodated within the magazine 108 is withdrawn from an outlet 112 of the magazine 108 and is loaded into the screw feed mechanism body 106 while being bent at an angle of about 90° relative to the strip withdrawing direction.

One such conventional successive screw feeder driver 101 permits the use of plural types of screws different in length so long as the difference in length of the screws falls within a certain operationally allowable range. However, to use screws, longer than that range requires the use of multiple screw feed drivers. Thus, the allowable range of screw length in one successive screw feeder driver is narrow. Dedicated successive screw feeder drivers 101 are required for short and long screws, respectively. In other words, a plurality of successive screw feeder drivers 101 are needed.

If the magazine 108 for receiving the screw strip S1 therein has a large depth, it can accommodate both the long and the short screws S. However, if extremely short screws S are accommodated in the magazine 108 having a large depth, there is a fear that the screw strip S1 which is in a coil form may get entangled within the magazine 108 and become unable to be withdrawn in a satisfactory manner. Besides, since the magazine 108 is attached to a side face of the successive screw feeder driver 101, the distance from the magazine 108 to the screw feed mechanism body 106 is long, and the outlet direction of the magazine 108 and the advancing direction of the screw strip S1 in the screw feed mechanism body 106 are not the same, so that the screw strip S1 is twisted as it is fed to the screw feed mechanism body 106, resulting in the operation thereof becoming unstable. Further, when the quantity of screws on the screw strip S1 becomes small, an end portion of the screw strip will jump out from the magazine, with the result that the screw strip S1 and the screws S become loose and are apt to damage a floor surface or a wall surface.

When the conventional successive screw feeder driver 101 is to be used for a floor surface, an operator thereof is required to operate the feeder driver 101 in a half-sitting posture or on his or her bended knees. In the case the screw driving operation continues over a long time, fatigue of the operator is apt to accumulate. Under the circumstances, it has been desired to develop a successive screw feeder driver which permits the operator to be standing up during the screw driving operation. Further, every time the screw driving operation is over, the operator is required to throw down the successive screw feeder driver 101 sideways and place it on a floor surface or the like, while when the screw driving operation is to be again started, the operator must lift the feeder driver 101. Thus, it is not easy to handle the successive screw feeder driver which is heavy.

The present invention has been accomplished in view of the above-mentioned problems and it is an object of the invention to provide a successive screw feeder driver employable at different mounting positions of a belt-like member of a screw strip and hence permitting the use of plural types of screws different in length, and further capable of accommodating even extremely short screws in a magazine without causing entanglement of the screws in the magazine.

DISCLOSURE OF THE INVENTION

In the successive screw feeder driver according to the present invention, a drive unit is mounted within a screw driving mechanism body having a grip handle, a screw driving bit is connected detachably to the drive unit, and a screw feed mechanism body is attached to the front portion of the screw driving mechanism body so as to be slidable in the longitudinal direction. Further, the bit is inserted rotatably into the screw feed mechanism body, and a screw driving depth adjusting mechanism for adjusting to what degree each screw is to be driven by the bit, is constituted in the interior of the screw driving mechanism body. Also constituted in the screw feed mechanism body is a screw feed mechanism. The screw feed mechanism functions to feed a belt-like member of a screw strip with a large number of screws arranged thereon side by side, to a screw driving position where the screws are driven by the bit. This screw feeding operation is performed in an interlock with a longitudinal slide of the screw feed mechanism body synchronized with the screw driving operation. Further, a front-end block having a projecting abutment surface is formed in the screw feed mechanism body in such a manner that it can be fixed at a desired position while being shifted in the longitudinal direction.

In the screw feed mechanism body there may be formed a plurality of screw head positioning grooves in parallel with the screw strip feed direction, or the position of a guide passage for the belt-like member of the screw strip may be made changeable.

Further, a magazine containing the screw strip may be attached removably to the screw feed mechanism body through a front-end block which can be fixed movably in the longitudinal direction. In the interior of the magazine, an inner lid having a boss formed around the axis thereof may be attached to the inner surface of an outer lid in a reversible and detachable manner.

An engaging recess may be formed in the rear portion of the screw driving mechanism body and an arm having a grip may be fitted in the engaging recess removably.

In the above construction, when the screw strip is loaded to the screw feed mechanism body, the screw located at the head assumes a screw driving position for driving the screw with the bit, while the belt-like member projecting sideways of the screw is inserted into a guide passage. In this position, the abutment surface of the front-end block in the screw feed mechanism body is pushed against a plate or the like and the drive unit is rotated, causing the bit to press against the screw. The resulting engagement of a clutch causes rotation of the bit, whereby the screw can be driven gradually into the plate. Upon start of this screw driving operation, the screw feed mechanism body, together with the front-end block, moves back slowly toward the screw driving mechanism body until the rear end of the front-end block integral with the screw feed mechanism body strikes against the screw driving depth adjusting mechanism constituted in the screw driving mechanism body. As a result, the clutch is released and the screw driving operation is over. Next, when the front-end block in the screw feed mechanism body is disengaged from the plate, the screw feed mechanism body is pushed out to its original position. At the same time, a screw feed means starts operating and a screw advance pawl in the screw feed means causes the ensuing screw on the screw strip to advance to the screw driving position, now ready for the screw driving operation in the same manner as above. In this way it is possible to perform the screw driving operation continuously.

When screws of extremely different lengths are used, their head positions on the belt-like member of the screw strip may be different. In this case, the screw heads are positioned in the respective appropriate screw head positioning grooves, whereby the screw strip can be loaded stably to the screw feed mechanism body.

In the case of using long screws, the front-end block is fixed at a front position of the screw feed mechanism body, while in the case of using short screws, the front-end block is fixed at a rear position of the screw feed mechanism body. By so doing, during the screw driving operation, the screw to be driven can be pushed against a plate surface in a stable condition.

In the interior of the magazine, if an inner lid is attached not only in a normal mounting state but also invertedly to the inner surface of an outer lid, it becomes possible to adjust the inside depth of the magazine in two stages. Consequently, even if short screws are received in a magazine having a large depth, it is possible to prevent entanglement of the screws in the interior of the magazine if the inner lid mounting state is proper adjusted.

Further, if an engaging recess is formed in the rear portion of the screw driving mechanism body and an arm having a grip is fitted in the engaging recess, not only the grip handle but also the arm grip can be used as a grip portion during the screw driving operation. It follows that the operator can keep a stand-up posture during the screw driving operation.

Additionally, since the magazine is attached to the front-end block of the successive screw feeder driver in a direction orthogonal to the screw driving direction, the front-end block and the magazine can serve as a base for keeping the successive screw feeder driver standing-up in a downwardly facing state. Thus, it is not necessary to throw down the successive screw feeder driver sideways at every completion of the screw driving operation and lift it again to restart the same operation.

BRIEF DESCRIPTION OF THE DRAWINGS

FIG. 12, FIGS. 12*a* and 12*b* illustrate a further embodiment of the present invention in which the mounting position of a screw strip guide can be changed to change the position of a screw strip guide passage, the screw chain guide passage being formed on the rear-end side, FIG. 12(*a*) being a plan view of a principal portion of a screw feed mechanism body, and FIG. 12(*b*) being an explanatory sectional view showing a positional relation between a screw strip guide portion and the screw chain;

FIG. 16 is a side view showing a still further embodiment of the present invention in which an arm is attached removably to the rear portion of a successive screw feeder driver according to the invention;

FIG. 17 is a side view of the arm portion;

FIGS. 17*a* and 17*b* illustrate a semicircular end of one tube of the arm portion;

BEST MODE FOR CARRYING OUT THE INVENTION

Figure 1:
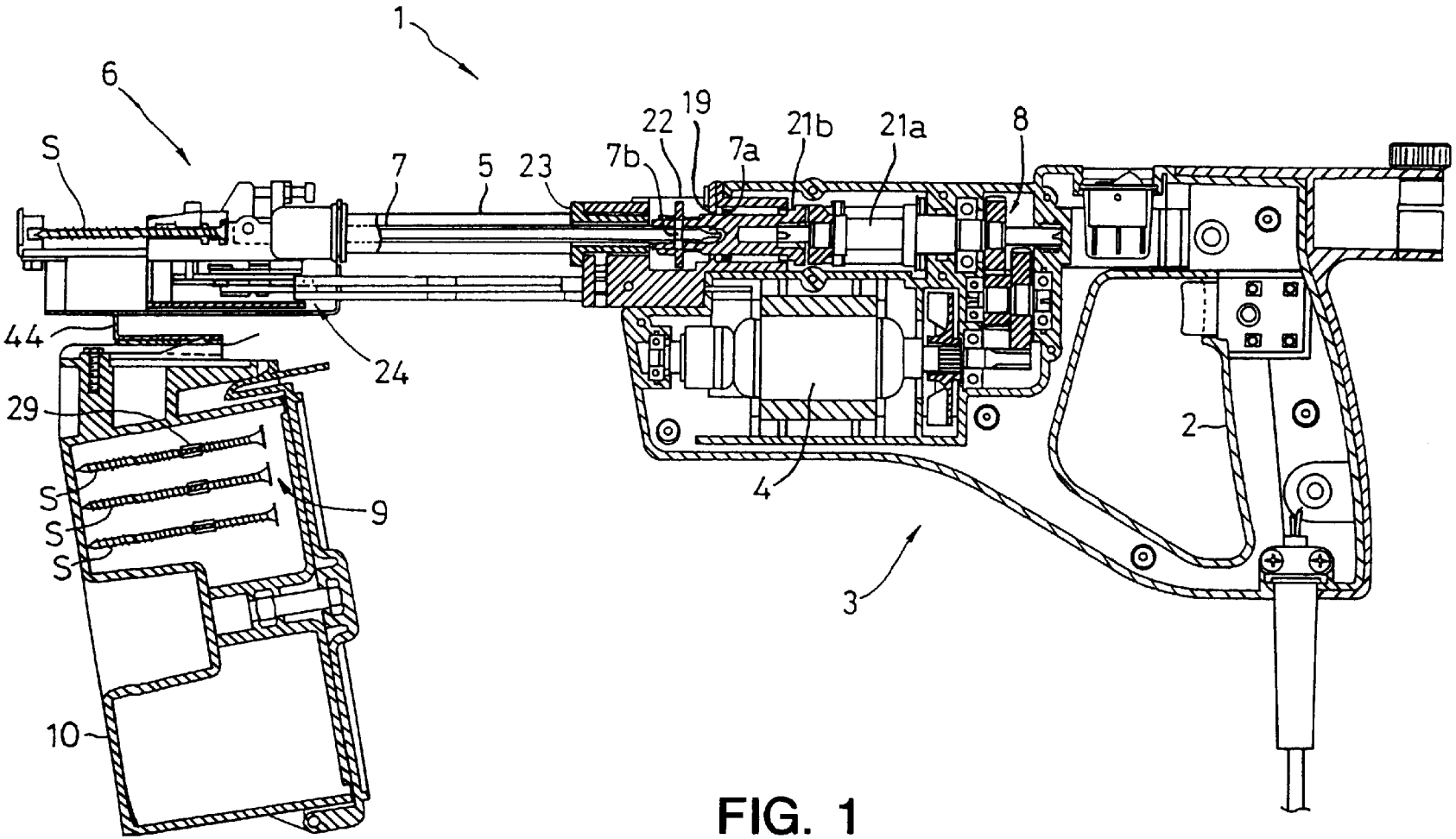
FIG. 1 is a sectional side view showing a successive screw feeder driver according to an embodiment of the present invention.
Figure 2:
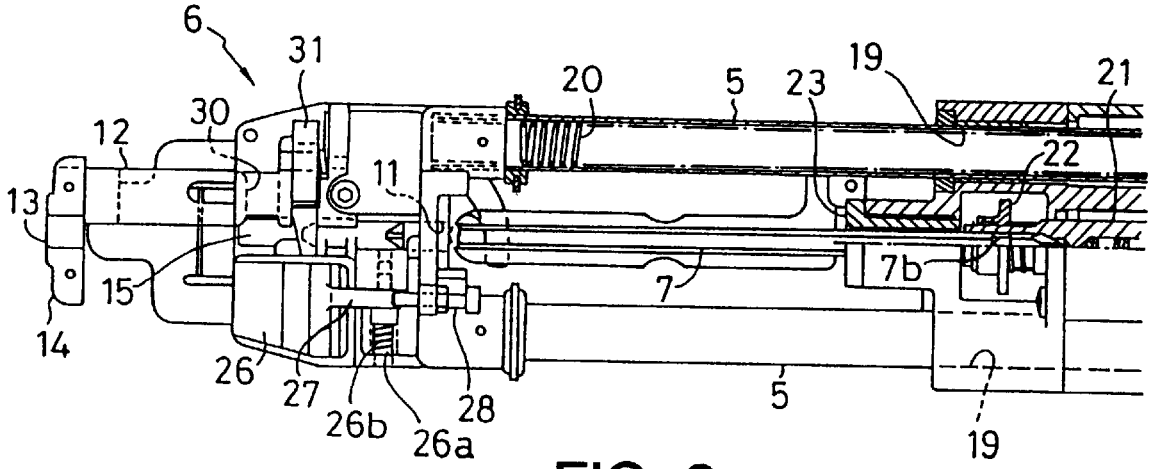
FIG. 2 is a partly cut-away plan view showing a screw feed mechanism body.
Figure 3:
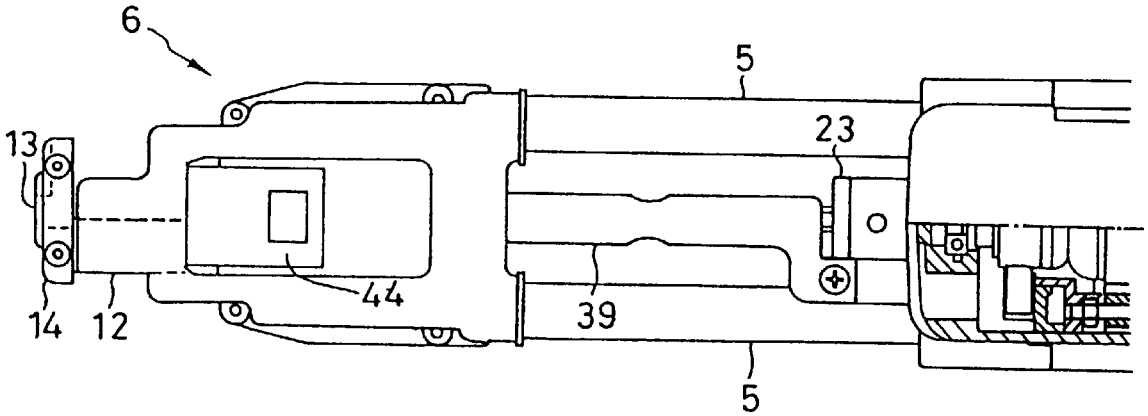
FIG. 3 is a bottom view of the screw feed mechanism body.
Figure 4:
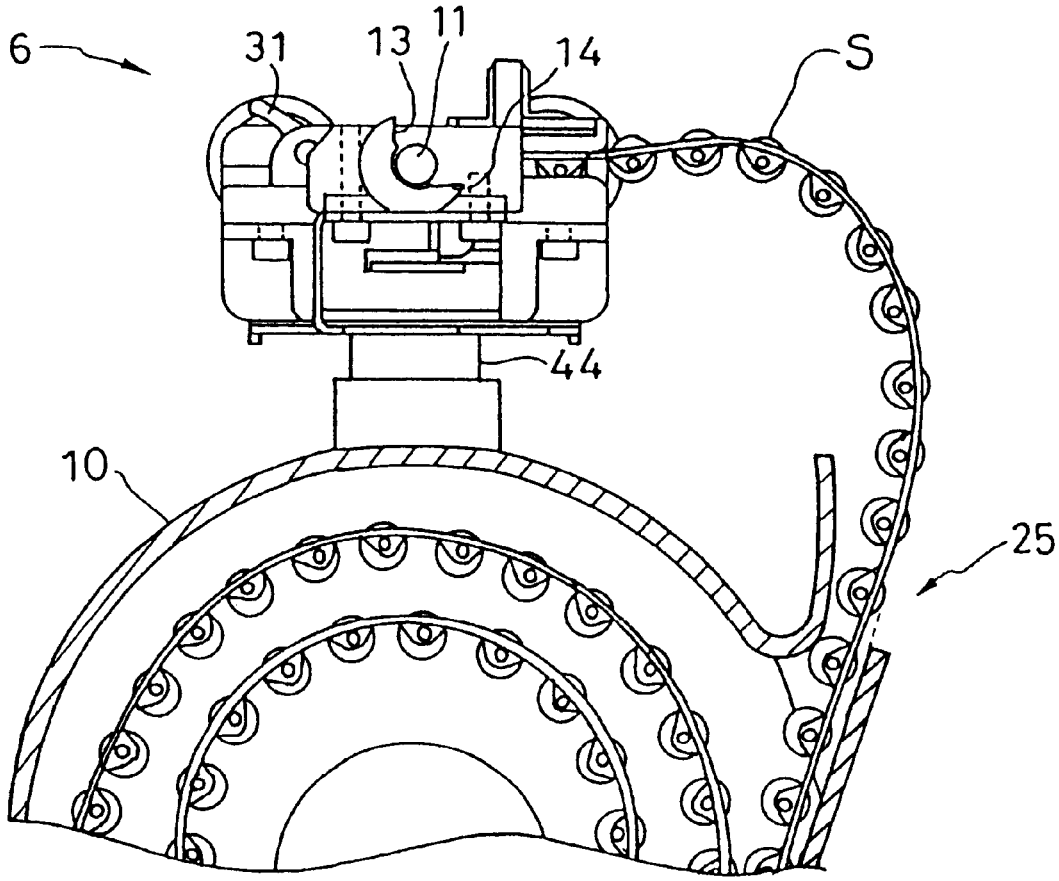
FIG. 4 is a partly cut-away front view of the screw feed mechanism body.
Figure 5:
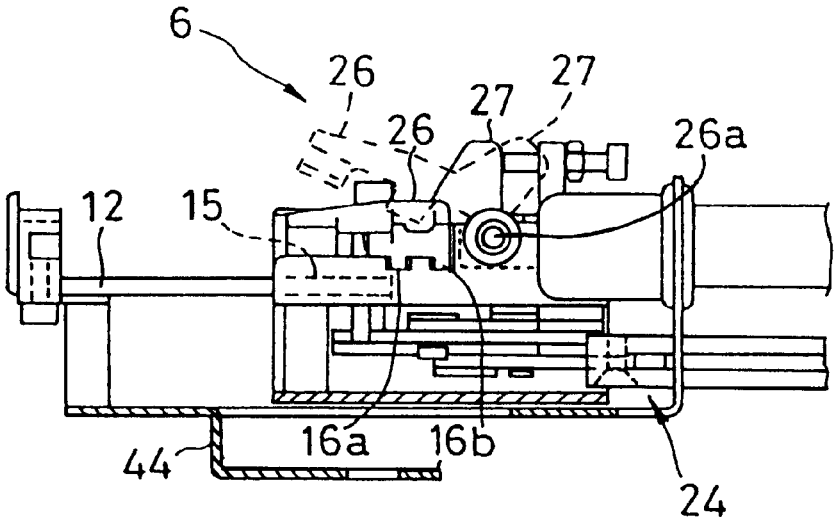
FIG. 5 is a side view of the screw feed mechanism body; which shows a guide cover in dotted lines in an open position FIGS. 6*a* and *d* are an explanatory view showing a relation between screws of different lengths with heads fitted in screw head positioning grooves in the screw feed mechanism body and mounting positions of a pressing bar which are different according to the positions of the screw head positioning grooves, FIG. 6(*a*) illustrates a mounting position of the pressing bar when the heads of short screws are fitted in the screw head positioning groove located on the front side, and FIG. 6(*b*) illustrates a mounting position of the pressing bar when the heads of long screws are fitted in the screw head positioning groove located on the rear side.

Embodiments of the present invention will be described in detail hereinunder with reference to the accompanying drawings.

In FIGS. 1 to 10, which illustrate a successive screw feeder driver according to an embodiment of the present invention, the reference numeral 1 denotes the successive screw feeder driver. In the successive screw feeder driver 1, a drive unit 4 such as a motor is mounted within a screw driving mechanism body 3 having a grip handle 2, and a screw feed mechanism body 6 is attached to the front portion of the screw driving mechanism body 3 through a pair of guide poles 5, 5 so as to be slidable back and forth. A single bit 7 for driving a screw S is disposed between and in parallel with the guide poles 5, 5. The bit 7 is connected detachably to a clutch 21*b* for rotation through a reduction mechanism 8, a rotating main shaft 21*a* and the clutch 21*b*. Further, a magazine 10 which receives therein a screw strip 9 in a coil form is attached to a front-end block 12.

The bit 7 is a member corresponding to the screw driver used commonly as a tool and is constituted by a shaft having a hexagonal section. At both ends of the bit 7 are formed engaging projections 7*a* each for engagement with an engaging groove such as, for example, + or − shaped groove formed on the head of each screw. Near each of the engaging projections 7*a* is formed a groove 7*b* circumferentially in mesh with a chuck 22. The front and rear positions of the bit 7 can be replaced with each other according to the degree of wear of both engaging projections 7*a*, 7*a*. When one or both engaging projections 7*a*, 7*a* are worn out, the bit 7 is replaced with a fresh one.

Through a nearly central portion of the screw feed mechanism body 6 is bored a hole 11 (FIGS. 2 and 4) extending in the sliding direction of the body 6. The hole 11 is for insertion of the bit 7 rotatably therethrough. The front-end block 12 is attached to the front end of the screw feed mechanism body 6 so as to be positioned in an extending direction of the hole 11. At the front end portion of the front-end block 12 is formed an abutment surface 14 (FIGS. 2, 3 and 8–10) for guiding a screw S which is driven by the bit 7 upon abutment with a workpiece, the abutment surface 14 having an L-shaped groove 13 which corresponds to a partial extension of the hole 11.

Further, nearly centrally of the upper surface of the screw feed mechanism body 6 is formed a screw feed groove 15 (FIGS. 2, 5 and 10) in the screw driving direction so that the head of the screw S can be pushed forward while rotating together with the bit 7. Also, screw head positioning grooves 16 are formed in the upper surface of the screw feed mechanism body 6 so that the head of the screw S which is fed from the left-hand side of the screw feed mechanism body 6 together with the screw strip 9 can be carried smoothly up to a screw driving position where the screw is driven by the bit 7. The screw head positioning grooves 16 extend up to the screw feed groove 15. In this embodiment, two screw head positioning grooves 16*a* and 16*b* (FIGS. 5, 6*a*, 6*b*, 7*a*, 7*b*) are formed in conformity with the head positions of two types of screws S, S having different lengths and arranged side by side at uniform intervals on a belt-like member 29.

Figure 6A:
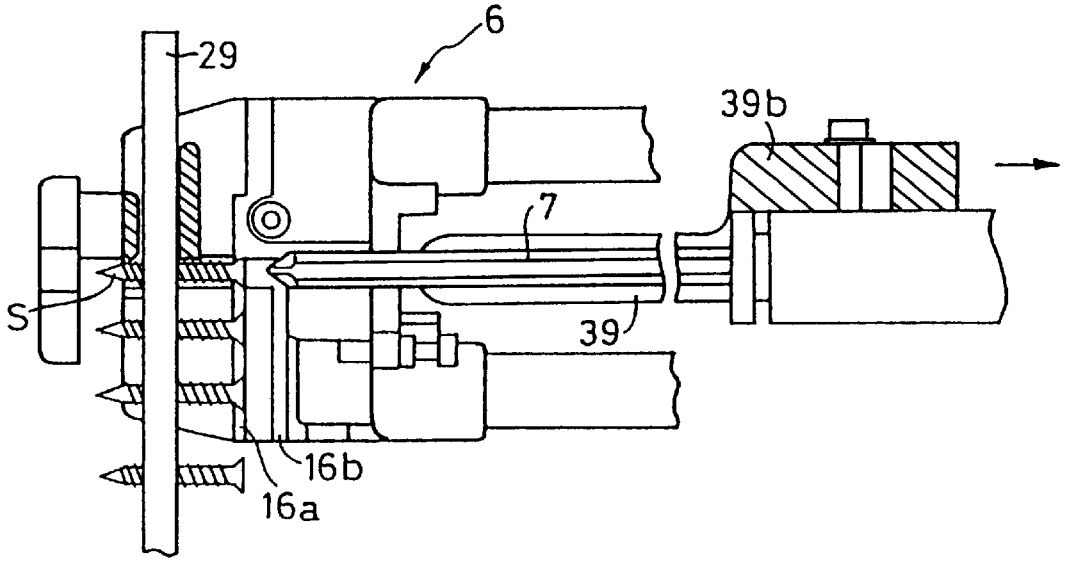
Figure 6B:
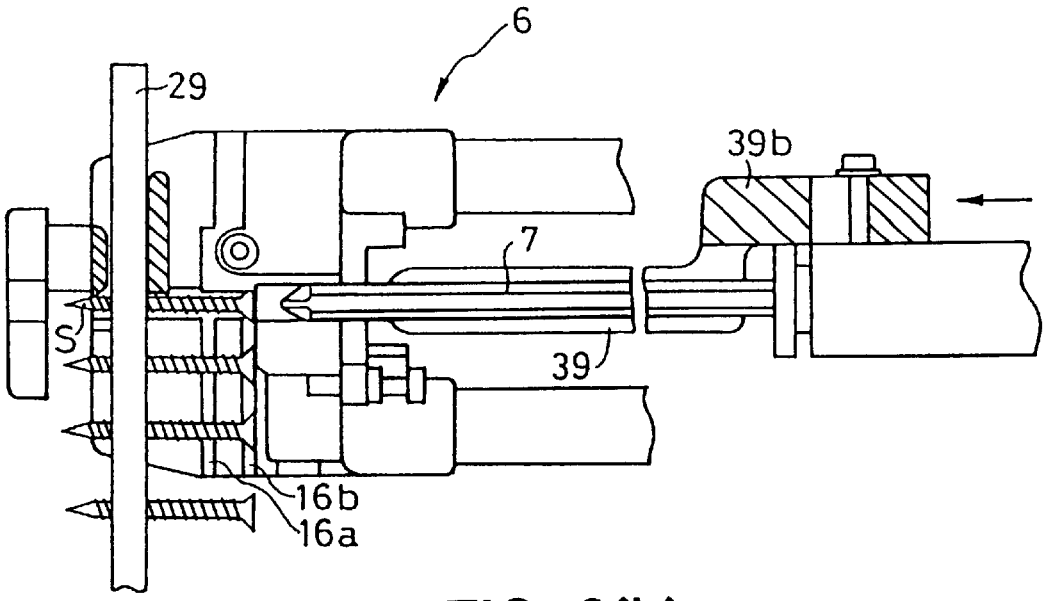
Figure 7A:
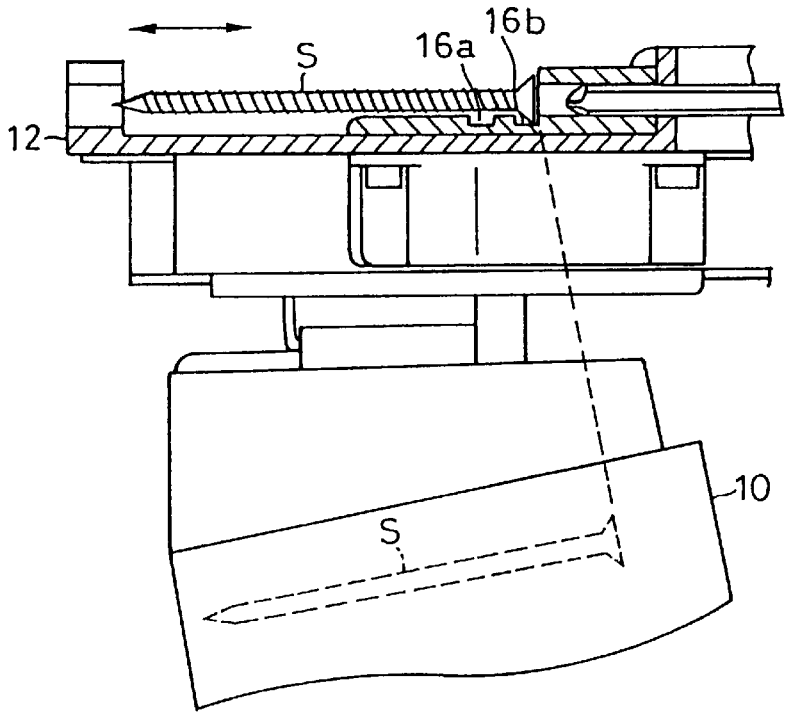
FIGS. 7*a* and *b* are an explanatory view showing a fixed state of a front-end block to the screw feed mechanism body, FIG. 7(*a*) illustrates a state in which the front-end block is fixed projectingly to the screw feed mechanism body, and FIG. 7(*b*) illustrates a state in which the front-end block is fixed in a rearward shifted state to the screw feed mechanism body.
Figure 7B:
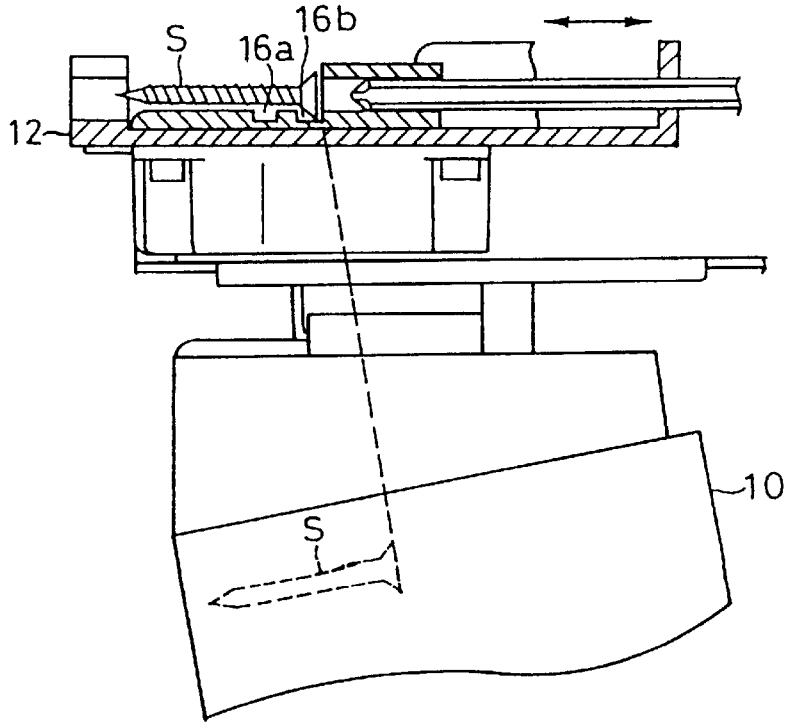

As shown in (FIGS. 6*a* and *b*), in order to keep constant the distance between the bit 7 and the head of the screw S, a rear end portion 39*b* of a pressing bar 39 is adjusted its position to be fixed in the longitudinal direction so that the pressing bar 39 is fixed short (see FIG. 6(*a*)) in the case of using the front-side screw head positioning groove 16*a* which is for short screws S and it is fixed long (see FIG. 6(*b*)) in the case of using the rear-side screw head positioning groove 16*b* which is for long screws S.

Figure 8:
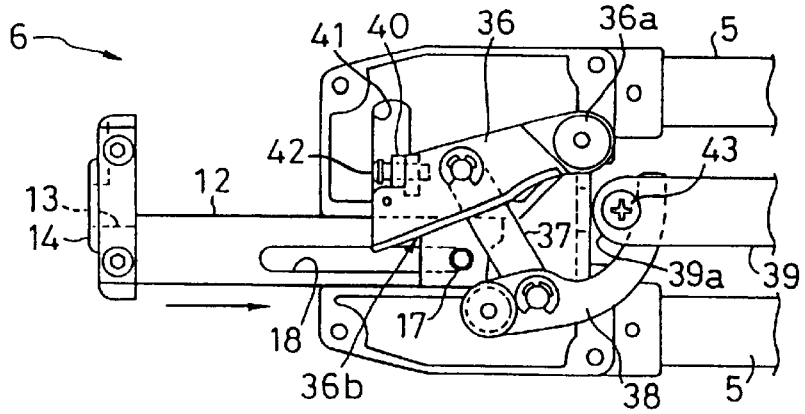
FIG. 8 is an enlarged bottom view of a principal portion, showing the screw feed mechanism body and a screw feed means, with a magazine bracket removed prior to movement of the front-end block.
Figure 9:
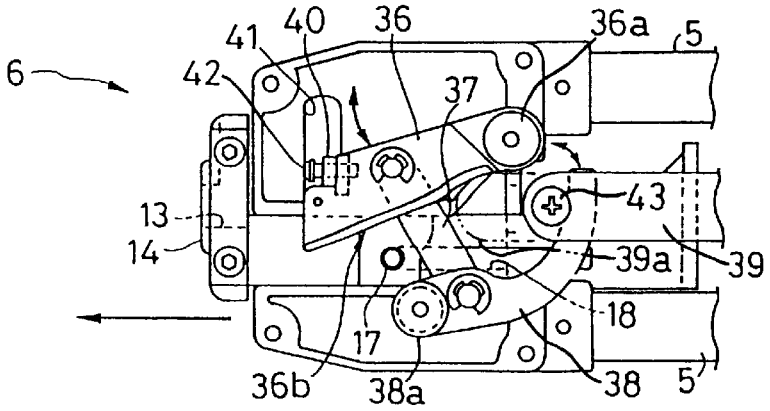
FIG. 9 is also an enlarged bottom view of the principal portion, showing the screw feed mechanism body and the screw feed means, with the magazine bracket removed after movement of the front-end block.

As shown in FIGS. 7 to 9, the front-end block 12 disposed in the screw feed mechanism body 6 can finely adjust its longitudinal projection length in the screw driving direction according to the length of screw S used. By loosening a set-screw 17 provided on the upper surface of the screw feed mechanism body 6, then by sliding the front-end block 12 in its sliding direction with the range of an elongated hole 18 formed longitudinally in the front-end block 12 and by tightening the set-screw 17, the front-end block 12 can be fixed at a desired position. As shown in FIG. 7, in the case of using long screws S, the projecting length of the front-end block 12 is set long (see FIG. 7(*a*)), while in the case of using short screws S, the projecting length of the front-end block 12 is set short (see FIG. 7(*b*)), whereby the screw driving operation can be performed stably at a short distance between a plate or the like and the tip end of screw S.

In the front end portion of the screw driving mechanism body 3 there are formed through holes 19, 19 for the two guide poles 5, 5 which are arranged in parallel on both sides of the bit 7. Resilient members 20, 20 (FIGS. 2 and 10), e.g. springs, are mounted within the through holes 19, 19, respectively. The resilient members 20 are for urging the screw feed mechanism body 6 toward a push-out position at all times by virtue of their biasing force. The bit 7 is fixed detachably at its groove 7*b* portion to the chuck 22 of the clutch 21*b* which is connected with the rotating main shaft 21*a*.

The screw driving depth of the bit 7 is adjusted by rotating an adjustor ring 23 which is provided centrally of the front side of the screw driving mechanism body and which serves as a screw driving depth adjusting mechanism. The adjustor ring 23 is formed in a cylindrical shape so that the bit 7 attached to the chuck 22 in the front portion of the screw driving mechanism body 3 can pass therethrough. The adjustor ring 23 is threadedly engaged with the screw driving mechanism body 3, and by adjusting its rotation, the degree of projection of the bit 7 from the front-end block 12 is adjusted to adjust the screw driving depth.

For example, when the adjustor ring 23 is turned clockwise, the screw driving depth becomes smaller, and when it is turned counterclockwise, the screw driving depth becomes larger. With increase in the degree of projection of the adjustor ring 23, the return portion of the screw feed mechanism 6 becomes shorter and the driving distance of the bit 7 becomes relatively short.

Conversely, with a decrease in the degree of projection of the adjustor ring 23, the return portion of the screw feed mechanism 6 becomes longer and the driving distance of the bit 7 becomes relatively long.

In the screw driving mechanism 3 and the screw feed mechanism 6 there is provided a screw feed means 24 for advancing the screws S on the screw chain 9 one after another to the screw driving position in interlock with the screw driving operation performed in the screw feed mechanism 6, in which driving position the screws S are driven by the bit 7 one by one. Above the screw feed mechanism 24, a guide cover 26 is mounted so that the guide cover can be raised and lowered in relation to the screw head positioning grooves 16*a* and 16*b* formed in the screw feed mechanism 6. The guide cover 26 functions to guide the screw strip 9 as the screw chain 9 is withdrawn from the screw feed mechanism 6. The rear end portion of the guide cover 26 is pivotally secured to a pivot shaft 26*a* so that the guide cover can be raised and lowered in the screw driving direction. The guide cover 26 is disposed in such a manner that a position adjusting screw 28 is normally in abutment with a projection 27 projecting from the upper surface of the guide cover. When the position adjusting screw 28 is in abutment against the projection 27 of the guide cover 26, the adjusting screw 28 also functions to prevent dislodgement of the screw strip 9 during the screw driving operation. As the pivot shaft 26*a* is moved transversely (leftwards) towards a biasing spring 26*b*, the position adjusting screw 28 comes out of abutment with the projection 27, so that the guide cover 26 can be largely opened upwardly. When the guide cover 26 is thus opened, a side face of the projection 27 comes into abutment against a length of the position adjusting screw 28, and in this opened state shown in FIG. 10 and by dotted lines in FIG. 5, the guide cover is maintained in an open position by the biasing force of the resilient member 26*b* acting rightward of the pivot shaft 26*a*, thus facilitating the removal of the screw strip 9.

On the side of the screw feed drive opposite to the guide cover 26 with respect to the screw feed groove 15 there is formed a guide passage 30 for insertion therethrough of the belt-like member 29 of the screw strip 9. In parallel with the guide passage 30 is disposed a rod-like engaging member 31. The engaging member 31 has an urging force to press down the belt-like member from above in order to prevent displacement of the screw S from a predetermined position as shown in FIGS. 2, 6*a*, 6*b* and 10.

With such forward or backward movement of the front-end block 12 and the magazine 10 as mentioned previously, the screw strip 9 matching the length of screw S used can be loaded to an appropriate position in the screw feed mechanism 6. Thus, the screw driving operation is performed while holding the screw strip 9 and the belt-like member 29 in place. Therefore, while carrying a large number of screws S, S side by side at uniform intervals and being held along the guide passage, the belt-like member 29 is required to have a strength enough to hold a screw S in the screw driving position without tilting during the screw driving operation.

Figure 11A:
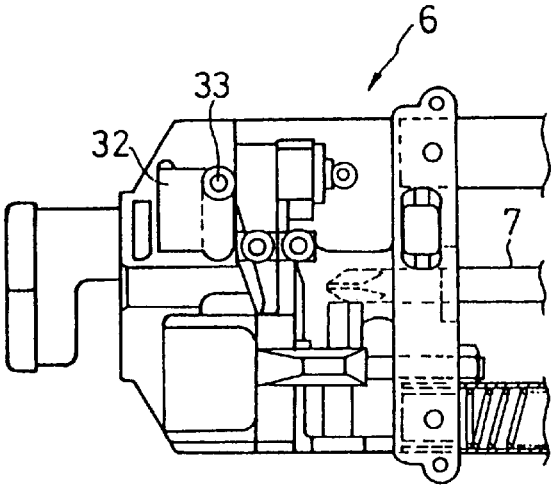
FIGS. 11*a* and *b* illustrate another embodiment of the present invention in which the mounting position of a screw strip guide can be changed to change the position of a screw strip guide passage, the screw chain guide passage being formed on the front-end side, FIG. 11(*a*) being a plan view of a principal portion of a screw feed mechanism body.
Figure 11B:
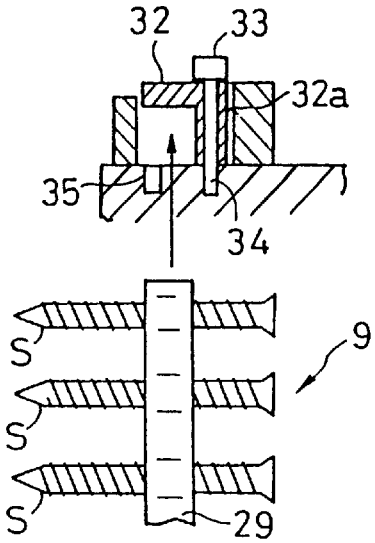
FIG. 11(*b*) being an explanatory sectional view showing a positional relation between a screw strip guide portion and the screw chain.
Figure 12A:
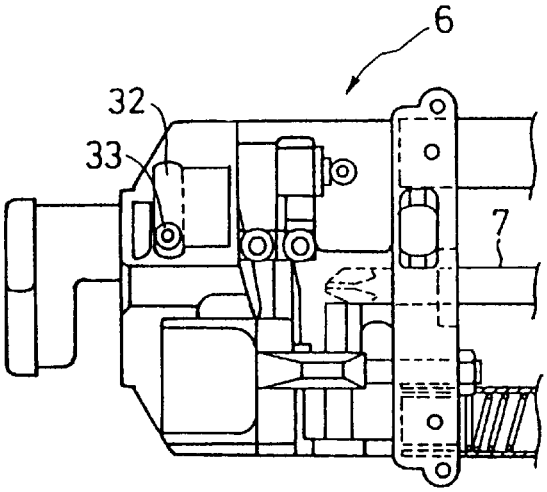
Figure 12B:
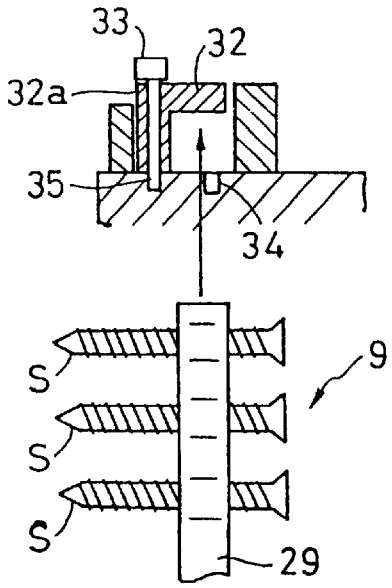
Figure 13:
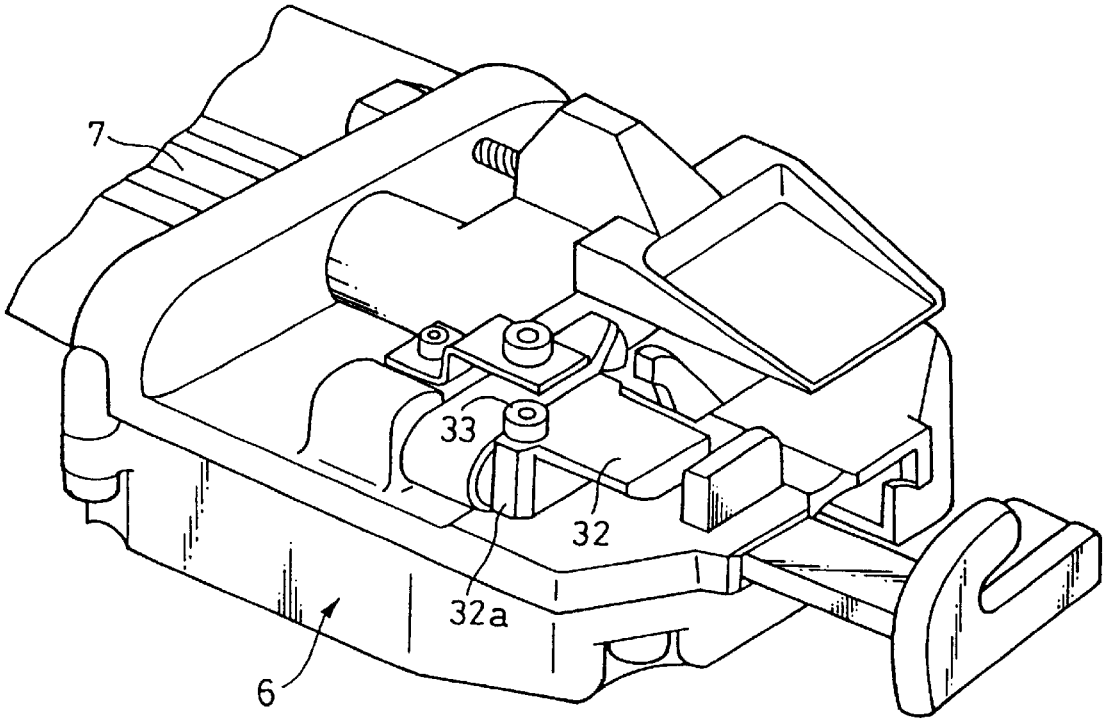
FIG. 13 is a perspective view of a principal portion of a screw feed mechanism body according to a still further embodiment of the present invention in which the mounting position of a screw strip guide can be changed to change the position of a screw strip guide passage.

FIGS. 11 to 13 illustrate other embodiments of the present invention with respect to the guide passage.

In these embodiments, a screw strip guide 32 having an inverted L-shaped section is attached removably to the screw feed mechanism 6. As shown in FIG. 11(*a*), when a set-screw 33 is inserted through a vertical wall 32*a* of the screw strip guide 32 and is threaded into a rear-side tapped hole 34 formed in the screw feed mechanism 6, a guide passage is formed on the front side as in FIG. 11(*b*). The belt-like member 29 of the screw strip 9 can be passed through the guide passage thus formed. Conversely, as shown in FIG. 12(*a*), when the screw strip guide 32 is turned oppositely and the set-screw 33 inserted through the vertical wall 32*a* is threaded into a front-side tapped hole 35, a guide passage is formed on the rear side as in FIG. 12(*b*). Thus, by changing the mounting position of the screw strip guide 32 in accordance with the position of the belt-like member 29 of the screw strip 9, it is possible to guide the belt-like member 29 to the proper position in an appropriate state.

Figure 10:
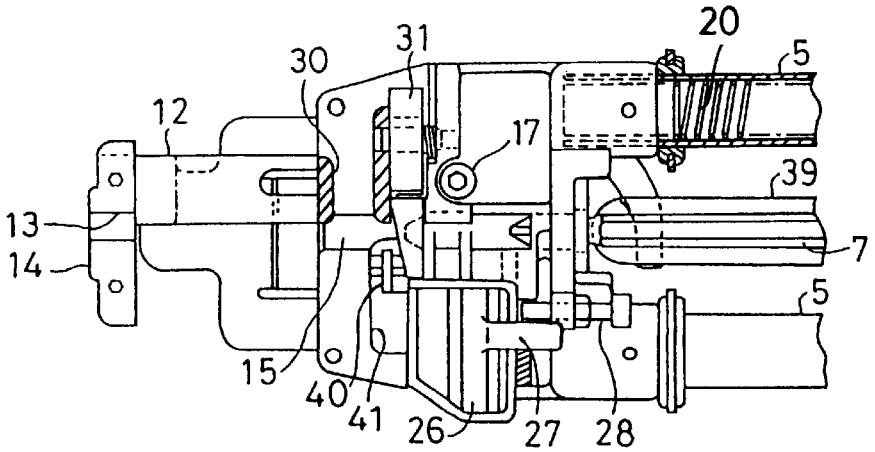
FIG. 10 is an enlarged, partly cut-away plan view of the screw feed mechanism body, with a guide cover moved laterally and opened upwardly as also show by dotted lines in FIG. 5.

The following description is now provided with reference to FIGS. 8 to 10 about the screw feed means 24 which feeds the screws S successively to the screw driving position (the position of the screw feed groove 15) in an interlock with the screw driving operation of the bit 7 and along the guide passage 30.

On the underside of the screw feed mechanism 6 a movable lever 36 is mounted so as to be pivotable horizontally about a base end 36*a* thereof, and a generally arcuate return lever 38 is also mounted pivotably in the horizontal direction about a base end 38*a* thereof, as shown in FIGS. 8 and 9. The return lever 38 is interlocked with the movable lever 36 through a link 37. With respect to a free end 36*b* of the movable lever 36, a pressing bar 39 is projected from the screw driving mechanism 3 in the sliding direction of the screw feed mechanism 6.

Projecting upward from the free end 36*b* of the movable lever 36 is a screw advance pawl 40. More specifically, the screw advance pawl 40 is projected upward through a screw feed slot 41 formed transversely toward the screw feed groove 15 formed in the screw feed mechanism 6. The screw advance pawl 40 is mounted pivotably in the feed direction of the screw strip 9 by means of a shaft 42. A resilient member (not shown) is disposed near the mounted position of the screw advance pawl 40 to urge the pawl 40 in the direction opposite to the screw chain feed direction.

During the screw driving operation, the movable lever 36 moves backward together with the screw feed mechanism 6 until reaching an abutment against a front end 39*a* of the pressing bar 39 which is fixed. Then, the movable lever 36 pivotally moves outward slowly. At this time, the screw advance pawl 40 moves toward the position of the ensuing screw S, namely, outwards of the screw feed mechanism 6. When the screw advance pawl 40 returns to its original position, screw advance pawl abuts the succeeding screw S located in parallel with the preceding screw, but there occurs no obstacle to the feed of the screw strip 9 because the pawl 40 is adapted to be lowered from an up position in the slot 41 with the shaft 42 which functions as a fulcrum.

Next, when the screw feed mechanism 6 is pushed back by means of the resilient members 20 disposed within the guide poles 5, the return lever 38 pivots so as to be returned to its original position by means of an engaging pin 43 provided projectingly on the front end portion of the pressing bar 39. In an interlock with this pivotal motion of the return lever 38, the movable lever 36 is also returned to its original position through the link 37. At the same time, the screw advance pawl 40 operates for returning to its original position.

Figure 14:
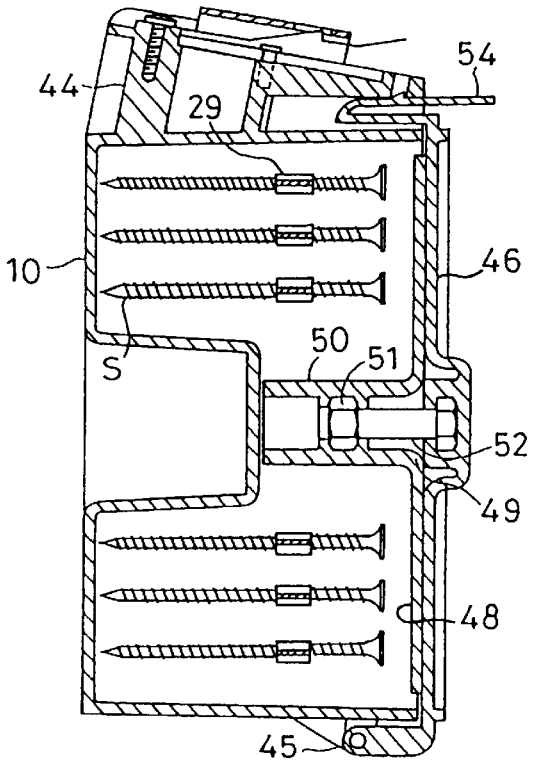
FIG. 14 is a sectional view of a magazine with long screws accommodated therein according to a still further embodiment of the present invention.
Figure 15:
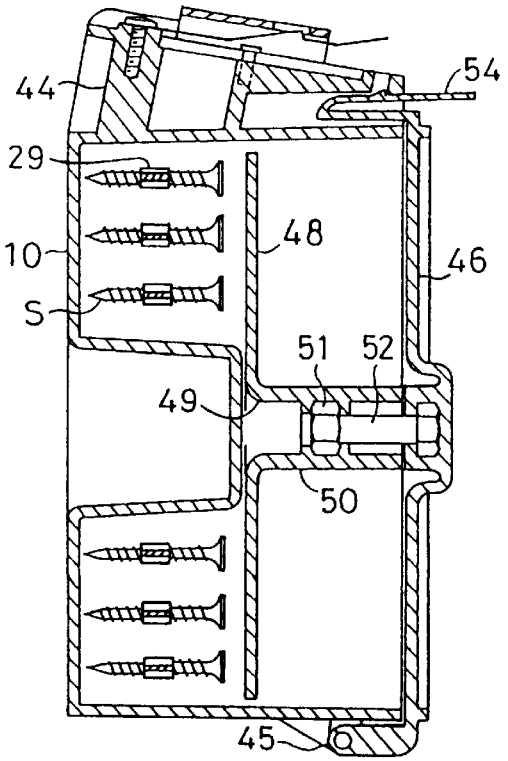
FIG. 15 is a sectional view of a magazine with short screws accommodated therein.
Figure 18:
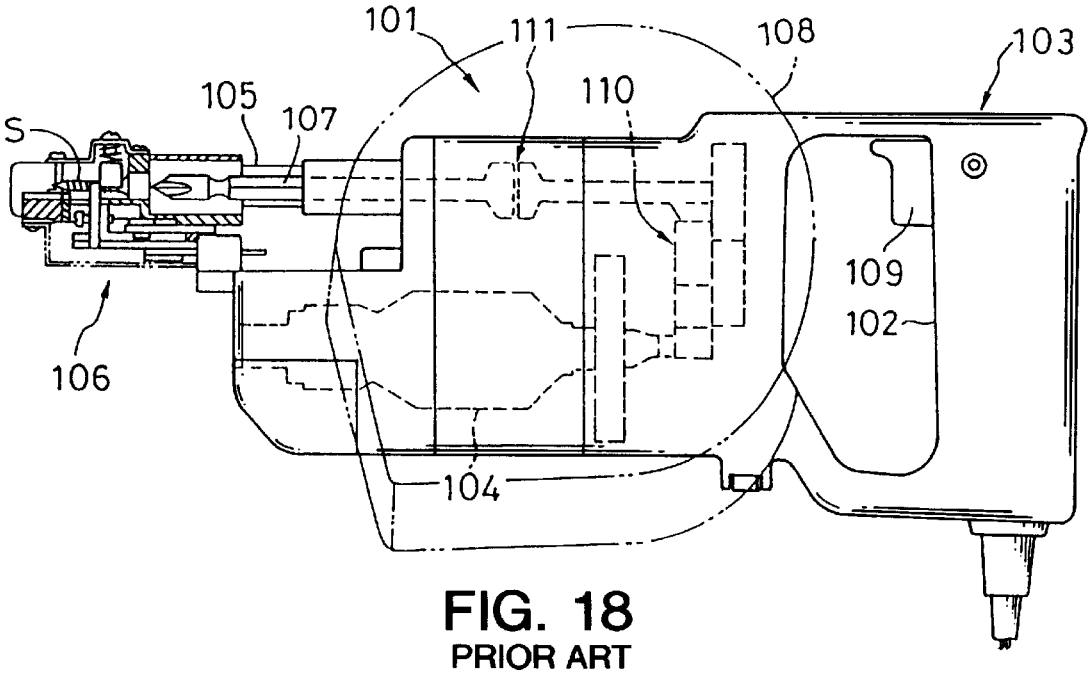
FIG. 18 PRIOR ART
FIG. 18 is a partly cut-away side view of a conventional successive screw feeder driver.
Figure 19:
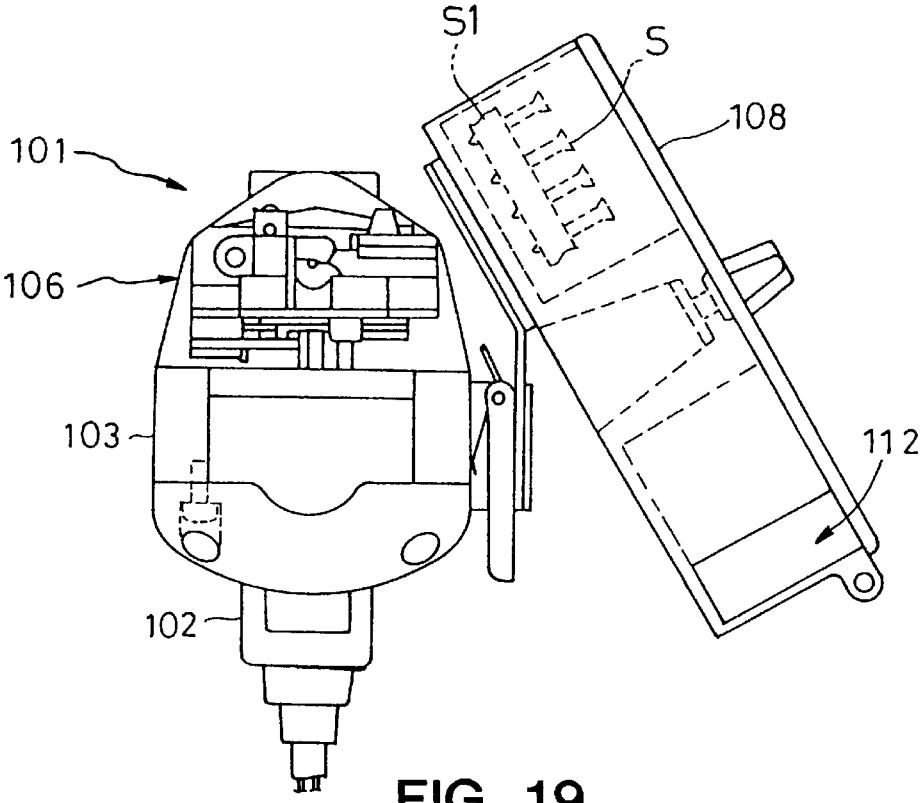
FIG. 19 PRIOR ART
FIG. 19 is a front view of the conventional successive screw feeder driver with a magazine attached thereto.

Referring now to FIGS. 14 and 15, there is illustrated a magazine which is attached to the successive screw feeder driver according to the present invention.

To the bottom of the screw feed mechanism 6 is attached a magazine 10 removably through a bracket 44 which is integral with the front-end block 12. The magazine 10 receives the screw strip 9 therein and is formed in the shape of a bottomed cylinder. In this embodiment, an outer lid 46 is attached to part of an opening of the magazine 10 so that it can be opened and closed with a hinge 45. Also in part of the magazine in the circumferential direction is formed an outlet 25 (FIG. 4) for the screw chain 9. One end of the screw strip 9 is received in a coil spiral form within the magazine 10, is withdrawn from the outlet 25 and is fed to the screw driving position for screw driving with the bit 7.

In the interior of the magazine 10 is mounted an inner lid 48 in a reversible manner so that plural types of screws S having extremely different lengths can be accommodated within the magazine. The inner lid 48 comprises a disc having an opening formed centrally and a hollow boss 50 formed projectingly on the center of one side of the disc. A nut 51 is fixed in the interior of the boss 51 so as to permit threaded engagement of a bolt with the nut 51 in any axial direction. And for threaded engagement with the nut 51, a bolt 52 is projected in the inner central direction from the inner surface of the outer lid 46. As shown in FIG. 14, when the nut 51 is fixed within the boss 50 and is brought into threaded engagement with the bolt 52 the disc surface of the inner lid 48 contacts the inner surface of the outer lid 46, it is possible to accommodate long screws S within the magazine 10. Conversely, as shown in FIG. 15, if the nut 51 is threadedly engaged with the bolt 52 so that the disc surface of the inner lid 48 is located at a middle position in the magazine 10, it is possible to accommodate short screws S within the magazine without any fear of entanglement of the screws.

Referring now to FIGS. 16 and 17*a*, and 17*b* there is illustrated an arm having grips, which arm can be attached removably to the successive screw feeder driver according to the present invention.

The numeral 55 denotes an arm having a front end portion 55*a*. The front end portion 55*a* is clamped with a knob 57 detachably into an engaging recess 56 to fix the arm 55, the engaging recess 56 being formed rearwards in the rear portion of the screw driving mechanism 3 of the successive screw feeder driver 1. As shown in FIG. 17, a pipe 59 which holds two grips 58, 58 formed of a foamed resin is attached to the arm 55 removably in a generally T-shaped form. The arm 55 is constituted by two pipes 60 and 61 of different diameters in such a manner that its overall length can be adjusted. The total length of the two pipes 60 and 61 is adjustable with a set-screw 62. In a rear end portion 55*b* of the arm 55 is formed a generally semicircular recess 63 so that the mounting position of the pipe 59 which holds the grips 58, 58 can be changed in the range of 90 degrees relative to the axis of the arm 55. FIGS. 17*a* and 17*b* illustrate an enlarged end of the pipe 60 shown in FIG. 17. As shown, the ends of the pipe 60 is formed with semicircular ends 63, 63*a*, which are formed at 90° to each other so that the grips 58 can be changed for different angles relative to the axis. In use, the end 61 of the adjustable pipes are secured to the end of the screw driving mechanism 3 and the pipe 60 is adjustable along the length of the pipe 61 in order to increase or decrease the length of the arm extension.

When the successive screw feeder driver 1 with the arm 55 thus attached thereto is used to drive screws to a floor surface, the operator can keep a stand-up posture and perform the screw driving operation while grasping the grips 58, 58. Even with a trigger switch 53 ON and the drive unit 4 rotating in the screw feed mechanism 6, the bit does not rotate unless the screw feed mechanism 6 is caused to slide. Thus, it is possible to ensure safety during the screw driving operation.

Further, since the magazine 10 is attached to the front-end block 12 of the successive screw feeder driver 1 detachably and perpendicularly to the screw driving direction, the front-end block 12 and the magazine 10 can serve as a base for keeping the successive screw feeder driver 1 upright. Thus, unlike the conventional like machines, it is no longer required to place the successive screw feeder driver 1 sideways at every stop of the screw driving operation and again lift it at the time of restarting the operation. In a stand-up posture the operator can restart the screw driving operation.

Operation of the successive screw feeder driver according to the present invention will be described below.

First, the outer lid 46 of the magazine 10 is opened by pulling out a stopper lath 54 of the outer lid 46, and the screw strip 9 which is in a coil form is put into the magazine 10. The front end portion of the screw strip 9 is pulled out from the outlet 25 and then the outer lid 46 is closed. The front end portion of the screw strip 9 thus withdrawn is loaded into the screw feed mechanism 6 in a closed state of the guide cover 26.

Next, the screw strip 9 is fixed by hand with at the position of the first screw S1 located one screw away from the center of the bit 7. Then, upon depression and release of the screw feed mechanism 6, the first screw S positioned at the head is advanced to the screw driving position (the position of the screw feed groove 15) by means of the screw advance pawl 40 in the screw feed mechanism 24, and the first screw S assumes the central position of the bit 7. In this way the first screw S is advanced to the screw driving position for driving the screw with the bit 7, the portion of the belt-like member 29 positioned on the front end side with respect to the screw S is inserted into the guide passage 30, and the screw S is pressed by the engaging member 31. In this state the abutment surface 14 of the front-end block 12 is pushed against a workpiece (a plate surface).

Now, the operator is required to push the trigger switch 53 located at the forefinger position of the grip handle 2 to rotate the drive unit disposed within the screw driving mechanism 3. The drive unit 4 causes rotation of the bit 7 which is connected to the clutch 21*b* through the reduction mechanism 8 and the rotating main shaft 21*a*.

When the drive unit 4 is rotated and the successive screw feeder driver 1 is pushed against the plate surface, the clutch

21*b* becomes engaged and the bit 7 rotates, whereby the screw S can be driven into the plate gradually. Simultaneously with the screw driving operation, the screw feed mechanism 6 moves back gradually toward the screw driving mechanism 3. In this way the screw driving operation is completed. More specifically, the front-end block 12 strikes against the screw driving depth adjusting mechanism (adjustor ring 23) engaged with the screw driving mechanism 3 to release the clutch 21*b* which connects the bit 7 with the reduction mechanism 8, so that the bit 7 stops rotation. When the rotation of the bit 7 stops, the front-end position of the bit is adjusted relatively by adjusting the distance of collision between the retreating screw feed mechanism 24 and the screw driving mechanism 3 with use of the adjustor ring 23. Thus, it is possible to adjust the screw driving depth (driving quantity).

As the successive screw feeder driver 1 is moved back from the plate after completion of the screw driving operation, the screw feed mechanism 6 is pushed out from the screw driving mechanism 3 side to its original position under the biasing force of the resilient members 20, 20. At the same time the screw feed means 24 starts operating and the screw advance pawl 40 causes the ensuing screw S on the screw strip 9 to advance to the screw driving position. Thereafter, the screw driving operation can b e conduct ed in the same manner as above. The screw S thus advanced to the screw driving position stands by in that position until the screw driving operation is started. The operations which follow are the same as described above. In this manner it is possible to effect the screw driving operation continuously.

During the screw driving operation in the successive screw feeder driver 1, the screw S located in the screw driving position is held in place by engagement of the screw strip 9 with the guide cover 26, the heads of the screws S carried on the screw strip 9 are held in place by the associated screw head positioning groove 16, and the portion of the belt-like member 29 remaining after screw driving is held by the guide passage 30. Thus, the screw S to be driven is conducted in to the L-shaped groove 13 formed in the front-end block 12 while retaining an extremely stable posture thereof. Besides, since the belt-like member 29 of the screw strip 9 has a strength sufficient to prevent tilting of the screw S being driven, the screw S is driven straight into a workpiece without tilting.

INDUSTRIAL APPLICABILITY

According to the successive screw feeder driver of the present invention, the screw located at the head of the screw strip can be loaded quickly and accurately into the screw feed mechanism. Moreover, since the belt-like member of the screw strip is inserted into the guide passage, each screw can be surely fed to the screw driving position at the time of screw driving operation and hence the screw driving operation can be performed continuously and accurately.

Even with screws of extremely different in length, it is possible to dispose the belt-like member of the screw strip at an appropriate position and let each screw advance in an accurate and stable state. Thus, coupled with fine adjustment of the longitudinal projection length of the front-end block, each screw can be advanced to the screw feed mechanism always in a stable state and it is possible to effect a stable screw driving operation. Accordingly, the successive screw feeder driver of the present invention, though it is a single machine, can perform the function of plural like machines.

Further, even in the case of using a magazine having a large depth, short screws can be accommodated therein without any trouble if an inner lid having a boss in its axial direction is mounted invertedly in the interior of the magazine. It is possible to prevent the screws from getting entangled within the magazine.

Additionally, since an arm having grips can be attached to the rear portion of the successive screw feeder driver, the operator can keep a stand-up posture during the screw driving operation. And since the successive screw feeder driver can be kept upright by using the magazine portion as a base, it is not necessary to place the successive screw feeder driver sideways at every stop of the screw driving operation. Thus, even in a stand-up posture the operator can restart the screw driving operation.

The foregoing relates to preferred exemplary embodiments of the invention, it being understood that other variants and embodiments thereof are possible within the spirit and scope of the invention, the latter being defined by the appended claims.

What is claimed is:

1. A successive screw feeder driver comprising:

a screw driving mechanism (3) having a grip handle (50);

a drive unit (4) disposed within said screw driving by mechanism for driving a screw;

a screw driving bit connected operatively and detachably to a clutch (21*b*) of said drive unit;

a screw feed mechanism (6) connected for adjustment longitudinally and slidably to a front portion of said screw driving mechanism, said screw driving bit being slidably insertable into said screw feed mechanism and rotatable by said drive unit (4);

a screw driving depth adjusting mechanism (23) in said screw driving mechanism for adjusting a depth a screw is to be driven by said bit;

a screw feed means (24) constituted in said screw feed mechanism for feeding screws carried on a carrier strip member successively one by one to a screw driving position, means for driving said screw driving bit and said screws simultaneously with a longitudinal sliding motion of said screw feed mechanism, said longitudinal sliding motion being synchronized with a screw driving operation performed by said screw driving bit, a carrier strip member carrying thereon a large number of screws side-by-side;

an adjustable screw guide passage for passage of said carrier strip member of said screws formed in said screw feed mechanism such that a position of said carrier strip member can be changed; and a front-end block having an abutment surface at a front end thereof, said front-end block being arranged adjustably in said screw feed mechanism and positioned at a desired longitudinal position with respect to the screw feed mechanism.

2. A successive screw feeder driver as set forth in claim 1, wherein a plurality of longitudinally spaced screw head positioning grooves are formed in said screw feed mechanism with said grooves in parallel with a direction in which said screws are fed into said screw feed mechanism.

3. A successive screw feeder driver as set forth in claim 2, further including a magazine for holding said carrier strip member of screws therein, said magazine being attached removably to said screw feed mechanism, and said front end block is movable in a longitudinal direction of the screw feeder driver.

4. A successive screw feeder driver as set forth in claim 3, wherein an inner lid (48) having a boss formed along an axis of said magazine is attached removably and reversibly to an inner surface of an outer lid in an interior of said magazine.

5. A successive screw feeder driver as set forth in claim 1, further including a magazine for holding said carrier strip member of screws therein, said magazine being attached removably to said screw feed mechanism, and said front end block is movable in a longitudinal direction of the screw feeder driver.

6. A successive screw feeder driver as set forth in claim 5, wherein an inner lid (48) having a boss formed along an axis of said magazine is attached removably and reversibly to an inner surface of an outer lid in an interior of said magazine.

7. A successive screw feeder driver as set forth in claim 6, further including an adjustable arm having a grip, said arm being removably attached to an engaging recess formed in an end portion of said screw driving mechanism.

8. A successive screw feeder driver as set forth in claim 5, further including an adjustable arm having a grip, said arm being removably attached to an engaging recess formed in an end portion of said screw driving mechanism.

9. A successive screw feeder driver as set forth in claim 1, further including an adjustable arm having a grip, said arm being removably attached to an engaging recess formed in an end portion of said screw driving mechanism.

10. A successive screw feeder driver as set forth in claim 2, further including an adjustable arm having a grip, said arm being removably attached to an engaging recess formed in an end portion of said screw driving mechanism.

* * * * *